US009079398B2

(12) United States Patent
Kozuka

(10) Patent No.: US 9,079,398 B2
(45) Date of Patent: Jul. 14, 2015

(54) LANDING POSITION MEASURING APPARATUS AND LANDING POSITION MEASURING METHOD

(71) Applicant: CANON KABUSHIKI KAISHA, Tokyo (JP)

(72) Inventor: Yuki Kozuka, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/566,791

(22) Filed: Dec. 11, 2014

(65) Prior Publication Data

US 2015/0165762 A1 Jun. 18, 2015

(30) Foreign Application Priority Data

Dec. 18, 2013 (JP) ..... 2013-261744

(51) Int. Cl.
*B41J 2/21* (2006.01)
*B41J 2/125* (2006.01)

(52) U.S. Cl.
CPC ..... *B41J 2/125* (2013.01)

(58) Field of Classification Search
CPC ..... B41J 29/393; B41J 2/2132; B41J 2/125; B41J 2/04561; B41J 2/04595; B41J 2/04558; B41J 2/04593
USPC ..... 347/14, 15, 19
See application file for complete search history.

(56) References Cited

U.S. PATENT DOCUMENTS 5,477,244 A 12/1995 Shibata et al.
6,752,483 B1 * 6/2004 Vega et al. ..... 347/19

FOREIGN PATENT DOCUMENTS

JP 04-336273 A 11/1992

* cited by examiner

*Primary Examiner* — Thinh Nguyen
(74) *Attorney, Agent, or Firm* — Fitzpatrick, Cella, Harper & Scinto

(57) ABSTRACT

There are provided a landing position measuring apparatus and a landing position measuring method capable of achieving normal evaluation or inspection without any erroneous recognition of a printed pattern. For this purpose, black pixels within a limitation area are regarded as ink ejected from one ejection port, followed by processing.

6 Claims, 10 Drawing Sheets h = 5

LANDING POSITION MEASURING APPARATUS AND LANDING POSITION MEASURING METHOD

BACKGROUND OF THE INVENTION

1. Field of the Invention

The present invention relates to a landing position measuring apparatus and a landing position measuring method for measuring the landing position of ink ejected from an inkjet print head.

2. Description of the Related Art

An inkjet print head fabricating process includes an inspecting process for evaluating whether or not ink ejected from an ejection port formed at an inkjet print head fabricated is landed at an accurate position on a print medium. A method in the inspecting process disclosed in, for example, Japanese Patent Laid-Open No. H04-336273(1992) has been known. With this method, an inspection pattern is printed in such a manner that droplets ejected from a plurality of ejection ports do not overlap each other, thereby measuring the position of gravity of each of dots. The quality of a print head is evaluated based on the uniformity of the landing position with reference to the position of gravity as a dot landing position.

The above-described ink droplet landing inspection pattern disclosed in Japanese Patent Laid-Open No. H04-336273 (1992) is adapted to evaluate the quality with reference to a single dot. However, in a case where the volume of a droplet to be ejected is small, a difference in area of a landed dot is small between a dot of a main droplet to be ejected and a dot of a satellite droplet to be sequentially ejected in a small quantity with a delay from the ejection of the main droplet. As a consequence, it may be difficult to determine whether the droplet is a main droplet or a satellite droplet in the ink droplet landing inspection pattern consisting of a single dot when a camera captures a droplet.

In view of the above, there is a method in which a print head is moved by a designated amount in a scanning direction while ejecting a plurality of ink droplets from ejection ports so as to form one pattern. The landing position of a droplet may be accidentally shifted due to an increased viscosity of ink or the like at the beginning of the ejection. To cope with this shift, it is necessary to eject droplets from one ejection port a plurality of times so as to form a pattern, thus complementing a landing position shift.

However, in ejecting droplets from one ejection port a plurality of times so as to form one pattern, such a pattern may be possibly broken caused by accidental deficient ejection or a flaw or smear on a sheet in the middle of the pattern. If the pattern broken in such a manner is inspected as it is, the pattern may be erroneously recognized, thereby raising a problem of abnormal evaluation or inspection.

SUMMARY OF THE INVENTION

In view of the above-described problems experienced by the related art, an object of the present invention is to provide a landing position measuring apparatus and a landing position measuring method capable of achieving normal evaluation or inspection without any erroneous recognition of a printed pattern.

Consequently, a landing position measuring method according to the present invention for measuring the landing position of a droplet ejected from an ejection port of a liquid ejection head onto a medium includes the steps of: forming a pattern with a plurality of droplets ejected from the ejection port; setting a limitation area including the pattern; obtaining the position of gravity of the limitation area; calculating the ideal position of the pattern based on the positions of gravity of the plurality of limitation areas; and measuring the landing position of the droplet ejected from the ejection port based on the position of gravity of the limitation area.

With the landing position measuring method according to the present invention, black pixels within the limitation area are regarded as ink ejected from one ejection port, followed by processing. Consequently, it is possible to achieve the landing position measuring apparatus and the landing position measuring method capable of normally evaluating and inspecting a printed pattern without any erroneous recognition of the printed pattern.

Further features of the present invention will become apparent from the following description of exemplary embodiments (with reference to the attached drawings).

DESCRIPTION OF THE EMBODIMENTS

First Embodiment

A first embodiment according to the present invention will be described below with reference to the attached drawings.

(General Configuration)

Figure 1:
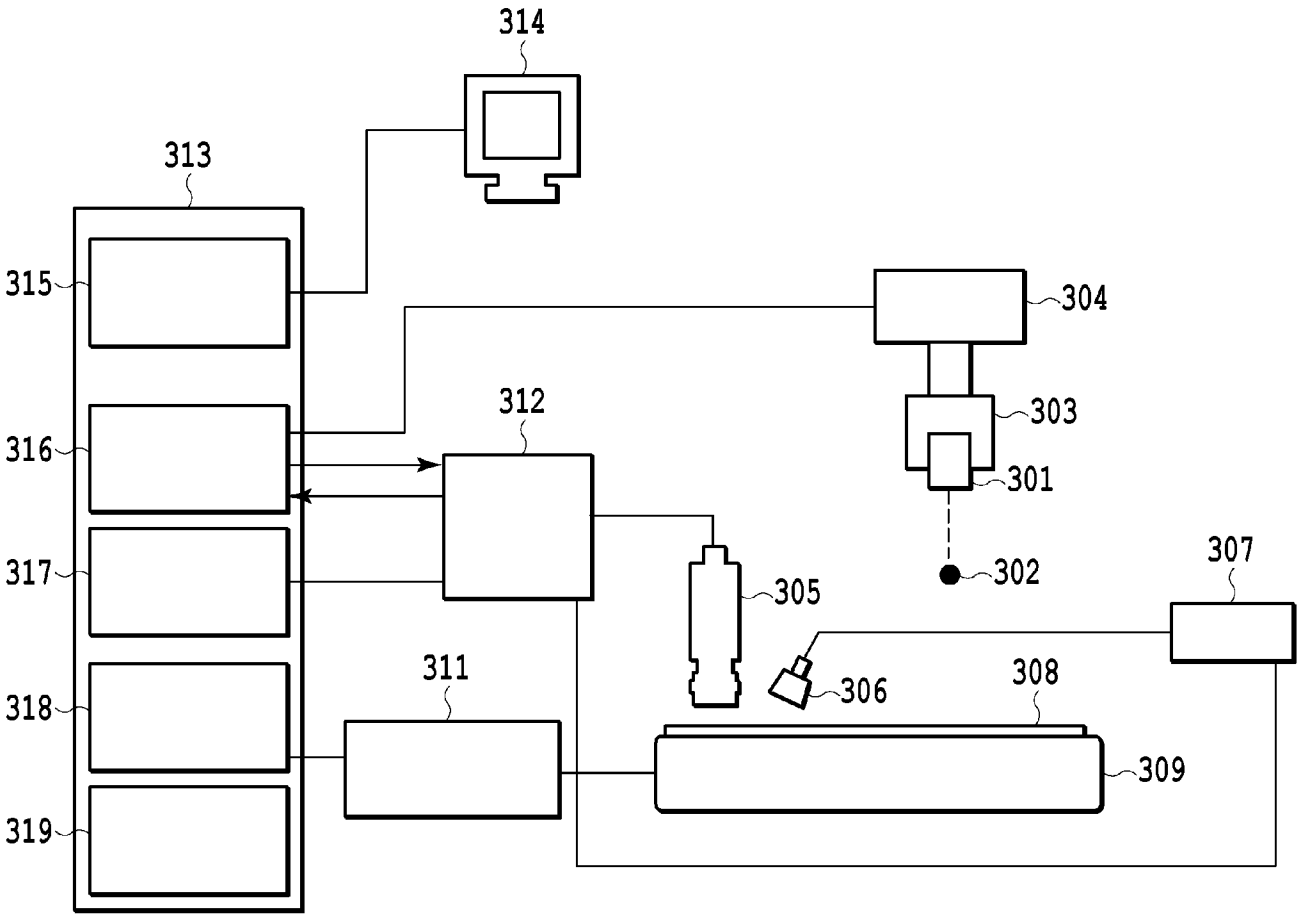
FIG. 1 is a block diagram illustrating the configuration of a print inspecting apparatus, to which a landing position measuring method according to the present invention is applied.

FIG. 1 is a block diagram illustrating the configuration of a print inspecting apparatus, to which a landing position measuring method according to the present invention is applied. An ink droplet 302 is ejected from an ejection port formed at an inkjet print head (i.e., a liquid ejection head) 301. The inkjet print head 301 is fixed to a carriage 303 in contact via a contact probe unit, not shown. To the carriage 303 is connected a print signal converting substrate 304 for converting a print signal transmitted from a head driver 316 into a signal suitable for the inkjet print head 301.

In the present embodiment, a luminaire 306 adopts LED illumination capable of outputting wavelengths according to red (R), green (G), and blue (B) colors and securing durability and light intensity stability. The luminaire 306 is connected to a luminaire power source 307. The luminaire power source 307 has an outside control terminal so as to control the light intensity for each of the RGB colors under control of an image processing control substrate 312.

A paper stage 309 is provided with an encoder, not shown, for acquiring stage position information. The paper stage 309 is controlled by a stage controller 311 such that a pattern consisting of an ink droplet, which is ejected from the inkjet print head 301 and landed on a print medium 308, falls within the angular range of a CCD camera 305. The print medium 308 is placed on the paper stage 309, and then, is sucked to the paper stage 309 by a vacuum or the like, so that the print medium 308 and the paper stage 309 are brought into close contact with each other. In the present embodiment, the print medium 308 is coated in such a manner as to uniformly absorb the ink droplet 302 when the ink droplet 302 is landed thereon.

The CCD camera 305 is used for reading a pattern consisting of the ink droplet 302 ejected from the inkjet print head 301. The present embodiment uses a line sensor type CCD camera. Merits of the use of the line sensor type CCD camera are a high resolution irrespective of a relative low cost and capture of only a necessary portion of a print pattern as an image. In this manner, the volume of image data is small even if an image has high resolution, thus improving throughput. The image data captured by the CCD camera 305 is transmitted to an image processing board 317 via the image processing control substrate 312. Here, the CCD camera 305 may be replaced with an area sensor type CCD camera as long as the image processing board 317 has satisfactory throughput at a high speed.

A controlling computer 313 incorporates therein a display outputting VGA board 315, for freely outputting an image to a monitor 314. Furthermore, the controlling computer 313 incorporates therein the head driver 316, the image processing board 317, and a motor control board 318, for freely performing each control at one time. Moreover, the controlling computer 313 incorporates therein a processor controller 319, for freely processing the image data captured by the image processing board 317 at a high speed.

(Inspection Pattern)

Figure 2:
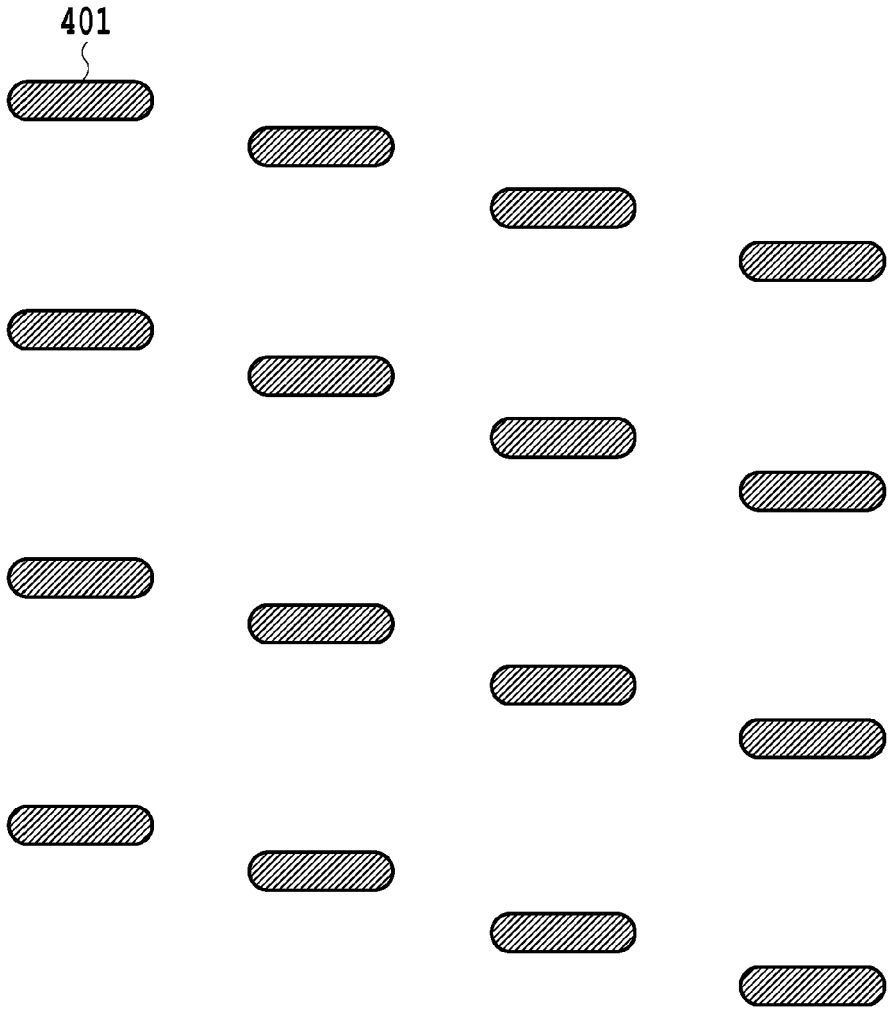
FIG. 2 is a diagram schematically illustrating an inspection pattern.

FIG. 2 is a diagram schematically illustrating an inspection pattern in the present embodiment. A pattern 401 is formed with the ink droplets 302 that are ejected from the ejection ports in the same array in the inkjet print head 301 and landed on the print medium 308. The pattern 401 is formed with the ink droplets 302 ejected from one ejection port a plurality of times. Moreover, the patterns 401 are arranged with an interval between the adjacent ejection ports in such a manner that ink droplets ejected from the adjacent ejection ports do not overlap each other.

(Configuration of Inkjet Printing Head)

Figure 3:
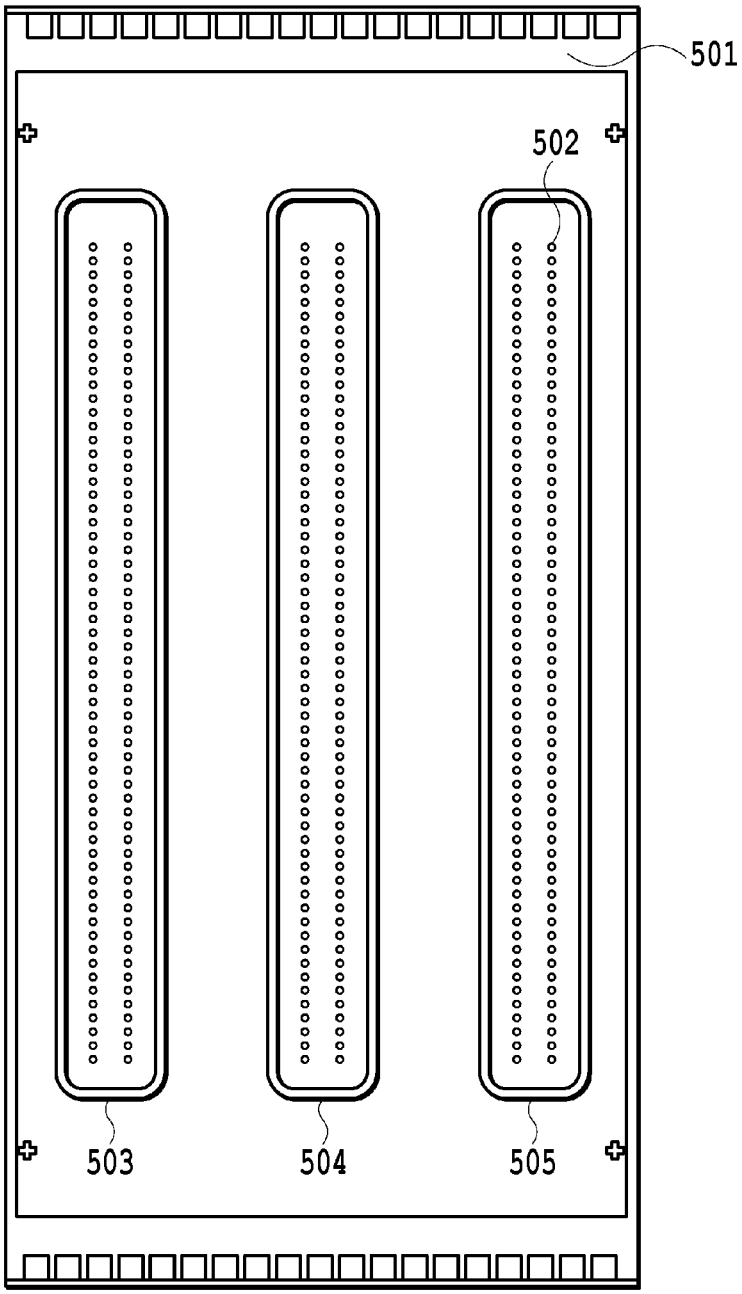
FIG. 3 is a view schematically showing a print element board for an inkjet print head.

FIG. 3 is a view schematically showing a print element board for the inkjet print head 301 used in the present embodiment. Ejection ports 502 are arrayed on a print element board 501, under which an electrothermal transducer, not shown, is provided for ejecting ink. On the print element board 501 in the present embodiment are arranged an ink ejection port array 503 for a cyan color, an ink ejection port array 504 for a magenta color, and an ink ejection port array 505 for a yellow color.

Explanation will be made below on inspection of the inkjet print head 301 provided with the above-described print element board 501.

(Details of Inspection Pattern)

Figure 4A:
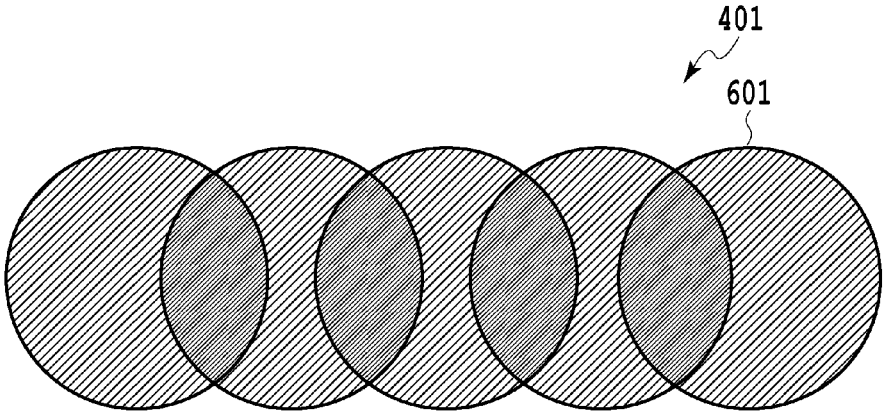
FIG. 4A is a diagram illustrating a pattern for use in measuring an ink droplet ejected.
Figure 4B:
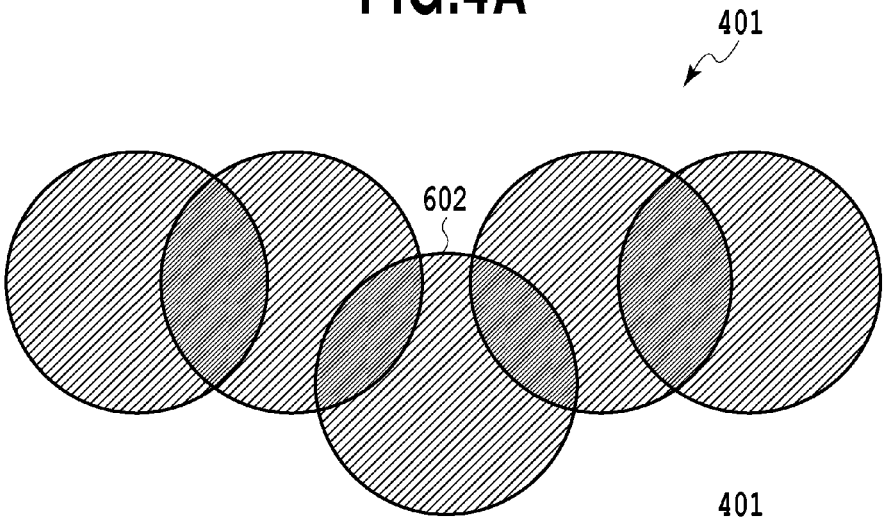
FIG. 4B is a diagram illustrating another pattern for use in measuring an ink droplet ejected.
Figure 4C:
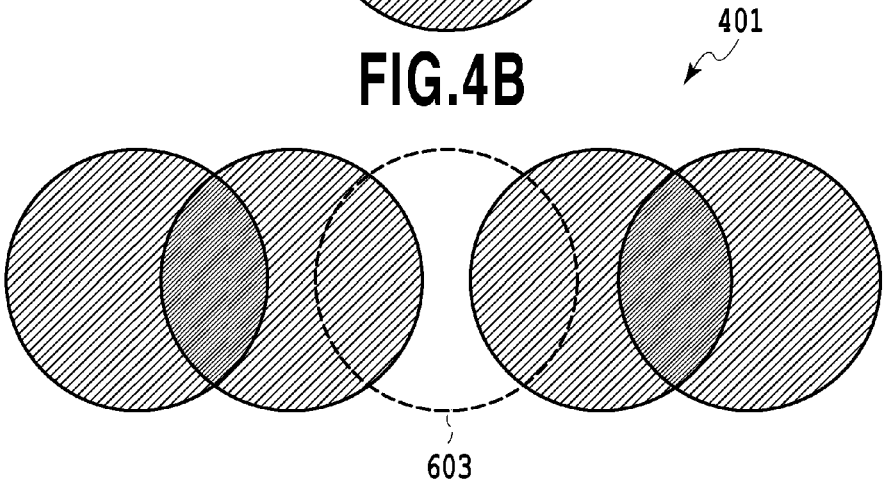
FIG. 4C is a diagram illustrating a further pattern for use in measuring an ink droplet ejected.

FIGS. 4A to 4C are diagrams illustrating the pattern 401 for use in measuring an ink droplet ejected from the inkjet print head 301 in the present embodiment. FIG. 4A illustrates a state in which five ink droplets are ejected from one ejection port and then are normally landed on the print medium 308. In the present embodiment, an ejection cycle is set to 15 kHz and the movement speed of the paper stage 309 is set to 12.5 inch/sec.

Under the above-described condition, the ink droplets ejected from one ejection port are landed with a shift at a landing position in a predetermined direction in such a manner that the droplets overlap each other by a preset area, thus forming one pattern 401. FIG. 4A illustrates ejected ink droplets 601 that are landed without any shift. As illustrated in FIG. 4B, an ink droplet 602 with a shift at a landing position caused by variously changed ejection statuses may form a pattern 401, although the droplets are ejected from one ejection port. In the case of pattern formation with one dot, such an accidental change in landing position may be fully reflected on a measurement value.

In order to avoid the above-described inconvenience, the five dots ejected from one ejection port overlap each other, thus forming the pattern 401 in the present embodiment. However, in a case where the five dots ejected from one ejection port overlap each other, thus forming the pattern, a void 603 of an ink droplet may occur caused by accidental deficient ejection due to various changes in ejection status, as illustrated in FIG. 4C. If deficient ejection occurs during sequential ejection from one ejection port, the pattern 401 is broken, thereby causing erroneous measurement to be induced.

(Pattern Capture)

A description will be given below of a pattern capturing method capable of accurately measuring a landing position even in a case where the pattern is formed with the ink droplets that are ejected from one ejection port and landed at shifted positions (FIG. 4B) or the pattern is broken caused by the deficient ejection during the sequential ejection (FIG. 4C).

Although explanation will be made herein on a case where the pattern is broken caused by the deficient ejection during the sequential ejection, the same goes for a case where the pattern is formed with the ink droplets that are landed at the shifted positions.

Figure 5:
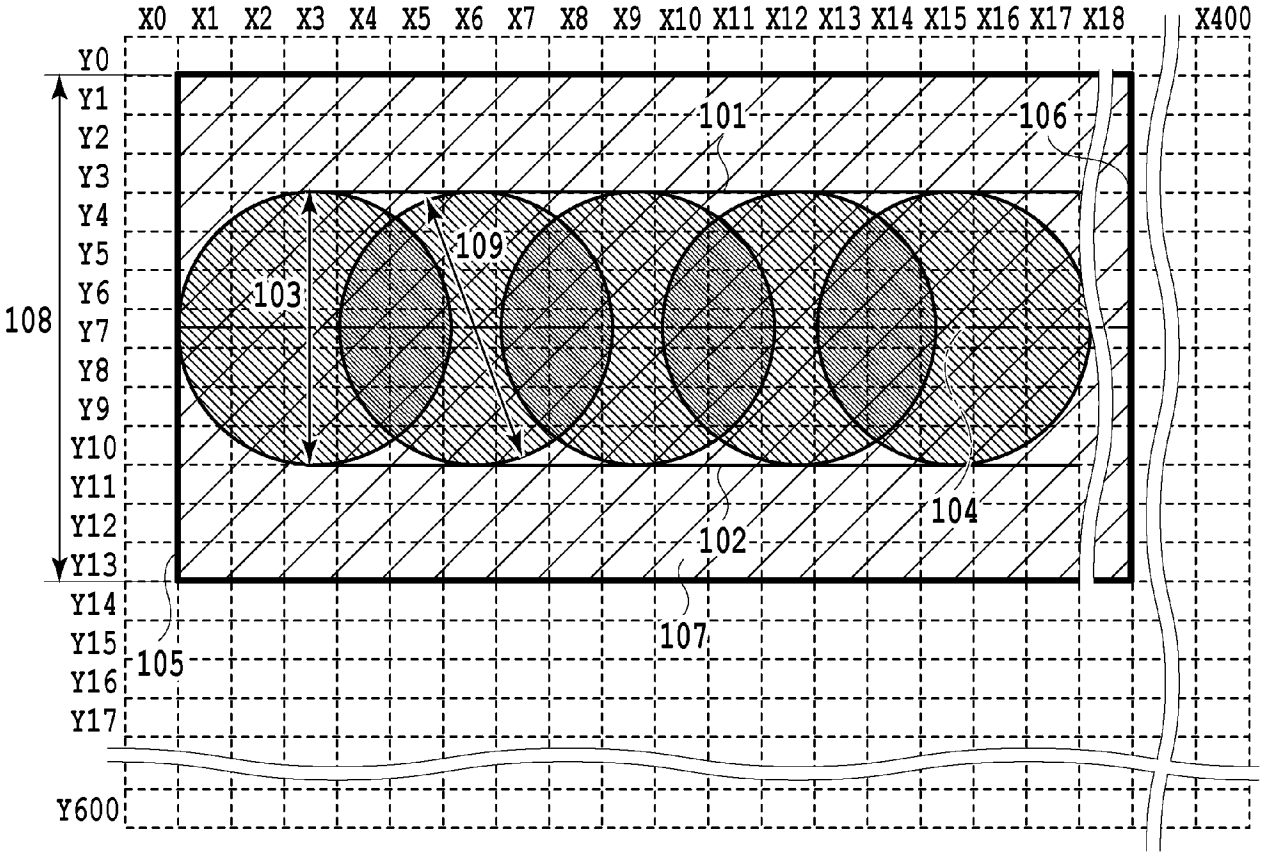
FIG. 5 is a chart schematically illustrating a method for recognizing a pattern formed of ink droplets ejected from one ejection port.

FIG. 5 is a chart schematically illustrating a method for recognizing a pattern consisting of ink droplets ejected from one ejection port. The X-Y coordinates in FIG. 5 represent pixel arrays in a CCD in the CCD camera 305. In capturing the pattern, first, a row X0 in the X coordinate is scanned from Y0 to Yend (i.e., Y600 in this embodiment) in ascending order of a coordinate address. And then, a position Ymin 101, at which the color of a pixel is changed from white to black, and a position Ymax 102, at which the black pixel is continuous and its color is changed from black to white, are stored. The same processing is performed from X0 to Xend (i.e., X400 in this embodiment). With this processing, it is possible to recognize an area, in which the ink droplets are landed in a direction transverse to a predetermined direction in which the landing positions are shifted.

Specific explanation will be made below by way of a row X3. A pixel concentration level is changed from white to black in coordinates (X3, Y4). Thereafter, the pixel concentration level remains black from coordinates (X3, Y4) to coordinates (X3, Y10). Subsequently, the pixel concentration level is changed from black to white in coordinates (X3, Y11).

And then, the two coordinates (X3, Y4) and (X3, Y11) indicating change points are stored.

(Recognition of Pattern Formed of Droplets Ejected from One Ejection Port)

The maximum Y coordinate value Ymax 102 and the minimum Y coordinate value Ymin 101 are calculated based on data indicating the change points in the above-described pixel array. And then, a pattern width D 103 is calculated according to the following equation:

$$D = Y\max - Y\min$$

Moreover, a pattern center DC 104 is calculated according to the following equation:

$$DC = (Y\max + Y\min)/2$$

Furthermore, the diameter d 109 of an arbitrary dot is obtained, and then, the length DL of the pattern is obtained by multiplying the diameter d 109 by the number n (n=5 in the present embodiment) of ink droplets ejected.

$$DL = d \times n$$

The pattern is identified in this manner.

The identifying method in the present embodiment is designed to recognize all of the black pixels existing within a defined area as the ink droplets ejected from one ejection port. First, the pattern center DC 104 is used for restricting an area in the Y coordinate. A landing position shift standard is applied to the pattern center DC 104, thereby setting a Y coordinate area width 108. Here, the landing position shift standard of the inkjet print head 301 is set to ±34 μm, and further, the Y coordinate area width 108 is set to 68 μm. Next, an X coordinate minimum value Xmin 105 is detected with respect to the black pixel within the above-described Y coordinate area, thus restricting an area in the X coordinate. Moreover, an X coordinate maximum value Xmax 106 shifted by the number n of ejected droplets (n=5 in the present embodiment) from the position is calculated by the following equation:

$$X\max = X\min + (d \times n)$$

The minimum Y coordinate value Ymin 101, the maximum Y coordinate value Ymax 102, the minimum X coordinate value Xmin 105, and the maximum X coordinate value Xmax 106 are set by the above-described calculations. In this manner, an ejection pattern from one ejection port is recognized, and then, the gravity of the pattern ejected from one ejection port is calculated based on coordinate data on all of black pixels within a limitation area 107.

(Measurement Flow)

Figure 6:
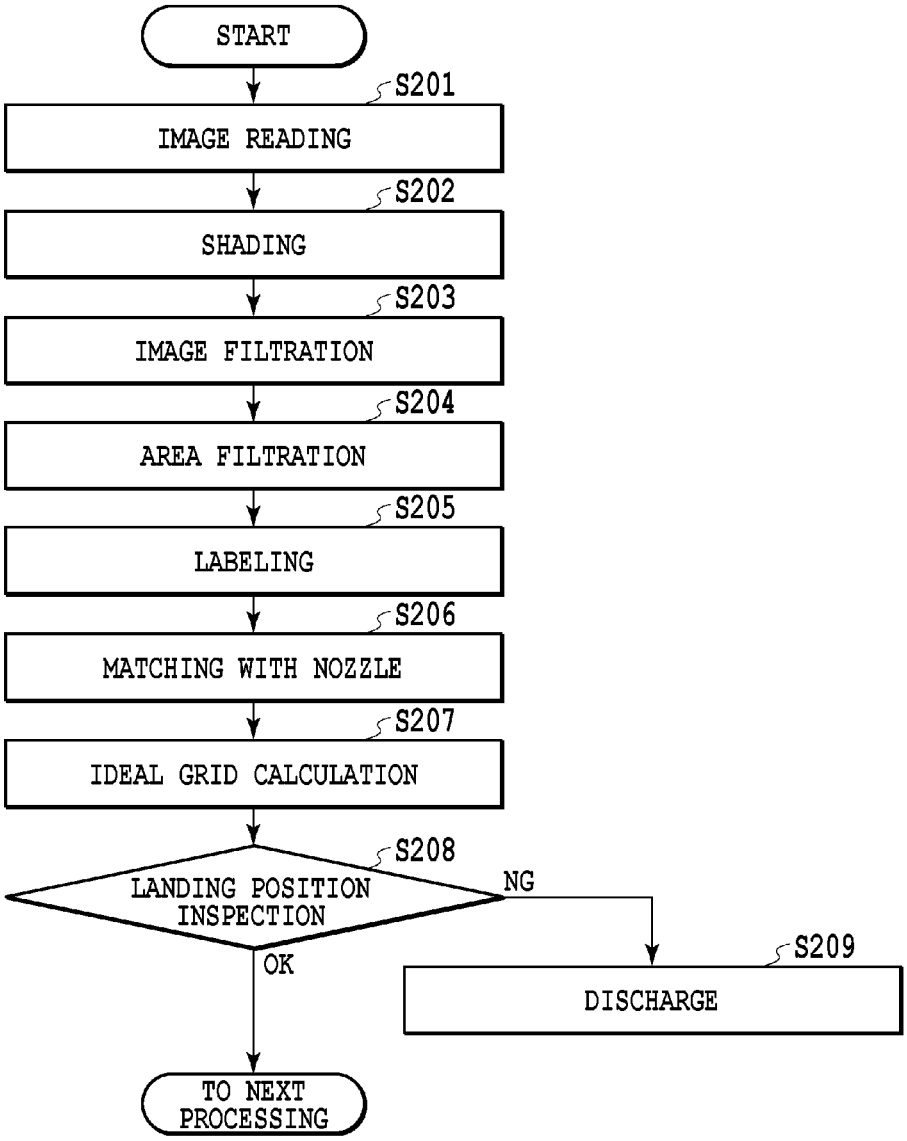
FIG. 6 is a flowchart illustrating inspection after an ink droplet is landed.

FIG. 6 is a flowchart illustrating inspection in landing position measurement after an ink droplet is landed by the inkjet print head 301 in the present embodiment. A description will be given below of an inspection flow with reference to the flowchart together with the above-described apparatus configuration diagram (FIG. 1).

Upon start of the inspection flow, an image of a specified size is picked up and read by the CCD camera 305 in step S201. Next, an inherent concentration unevenness is eliminated (shaded) within the picked-up image in step S202. Causes for the inherent concentration unevenness include CCD arrangement characteristics, the characteristics of the luminaire 306, and the like. Subsequently, noise is removed by the use of an expansion/contraction filter during image filtration in step S203.

Waste such as adhesion of dust onto the CCD, a lens, or a sheet or adhesion of mist generated during the ejection of an ink droplet is conceived as causes for the noise. Thereafter, in step S204, the noise that cannot be removed during the image filtration is subjected to area filtration for removing a specified area (½ to ⅓ of an area of one dot in the present embodiment) or smaller. The landing position of a best image obtained through the above-described noise processing is measured.

Figure 7:
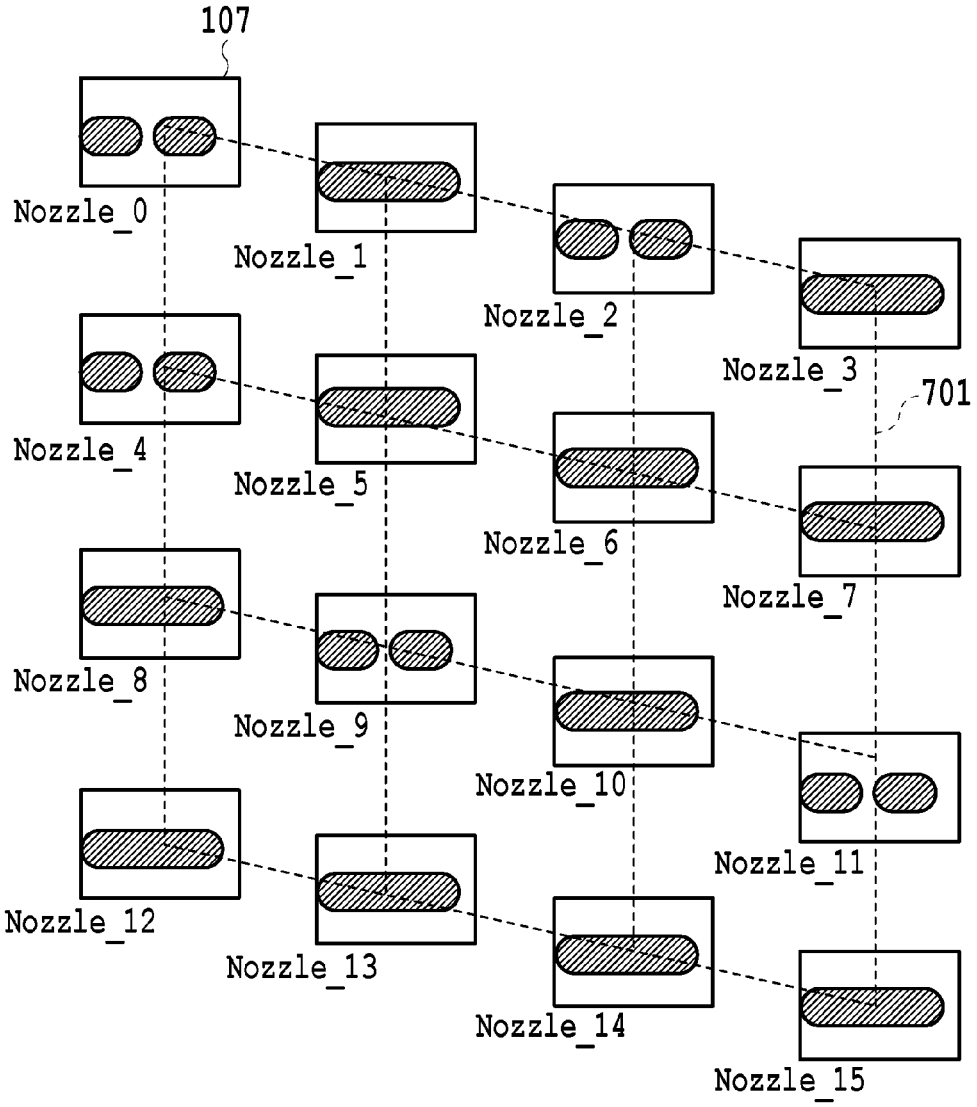
FIG. 7 is a diagram schematically illustrating a landing position inspecting method.

Here, FIG. 7 is a diagram schematically illustrating a landing position inspecting method. During labeling in step S205, ejection pattern recognition processing with respect to one ejection port is performed, thereby setting each of the limitation areas. Thereafter, the set limitation area is matched with the ejection port for use in forming the pattern within the limitation area in step S206, as illustrated in FIG. 7. Next, in step S207, ideal grid calculation is carried out based on the position of gravity of the labeled pattern within the limitation area, and then, grid coordinates 701 at an ideal landing position (i.e., without any misregistration) are obtained by the least squares method.

Subsequently, a difference between the grid coordinates 701 (i.e., the ideal position of the pattern) obtained in step S207 and the position of the gravity of an actual pattern is calculated during landing position inspection in step S208. With this calculation, deficient ejection, misregistration, a deficient landing area, or the like is inspected. If the pattern is deficient, it is discharged from the apparatus in step S209. In contrast, if the pattern is good, the printed pattern is fed to next processing.

As described above, when the landing position of an ink droplet ejected from the inkjet printing head is measured, ink is ejected from one ejection port a plurality of times, and then, the black pixels within the limitation area are recognized as ink ejected from one ejection port, followed by the processing.

Incidentally, although ink ejection has been exemplified in the present embodiment, the present invention is not limited to this. Any liquids can be used as long as they can be recognized by the CCD camera.

In the above-described manner, it is possible to achieve the ink droplet landing position measuring method and the ink droplet landing position measuring apparatus with high accuracy and without any erroneous determination even if deficient ejection or landing shift accidentally occurs when the landing positions of the ink droplets ejected from the plurality of ejection ports are measured.

Second Embodiment

A second embodiment will be described below with reference to the attached drawings. Here, the basic feature of the present embodiment is the same as that of the first embodiment, and therefore, only distinctive features will be explained below.

The present embodiment and the first embodiment are different from each other in a pattern identifying method.

(Details of Pattern)

Figure 8:
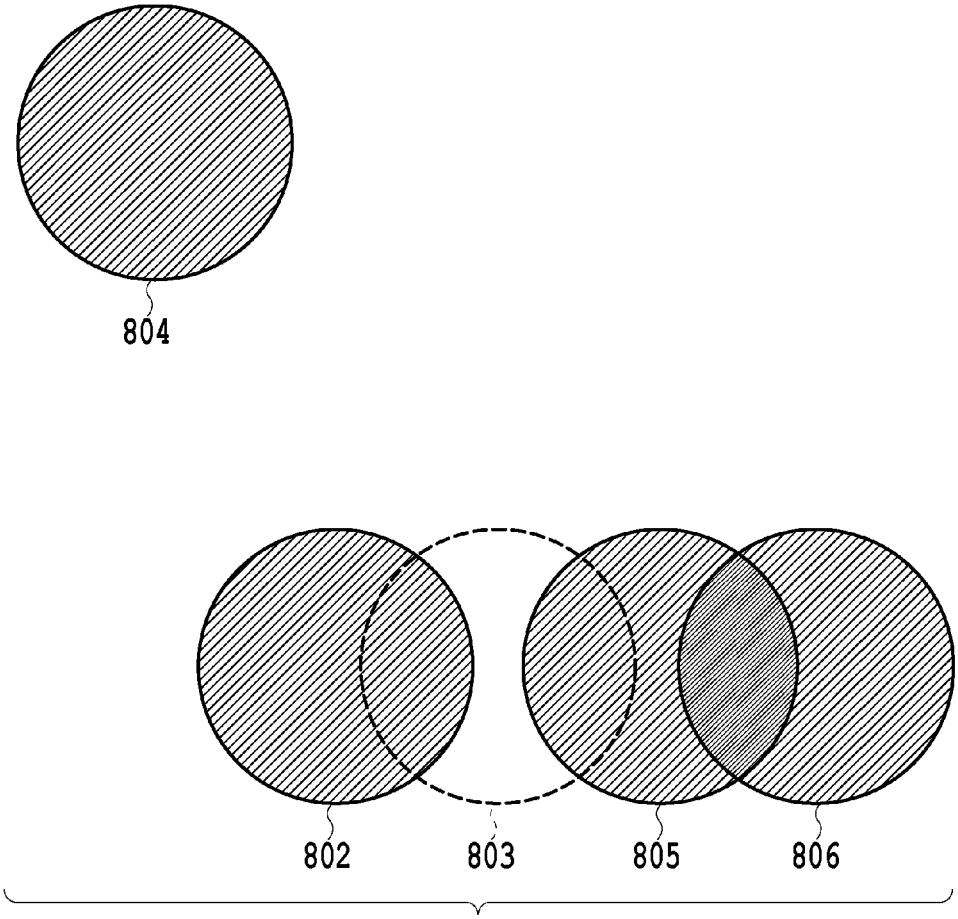
FIG. 8 is a diagram schematically illustrating an ink droplet landed on a print medium.

FIG. 8 is a diagram schematically illustrating an ink droplet landed on a print medium. The deficiency of a pattern in the present embodiment will be explained with reference to FIG. 8. FIG. 8 illustrates a pattern in which initial ejection becomes relatively unstable caused by the characteristics of the inkjet printing apparatus, the landing position of a first dot 804 is largely shifted by accident, and a void 803 of an ink droplet is caused by accidental deficient ejection.

(Ejection Pattern Recognition from One Ejection Port)

Figure 9:
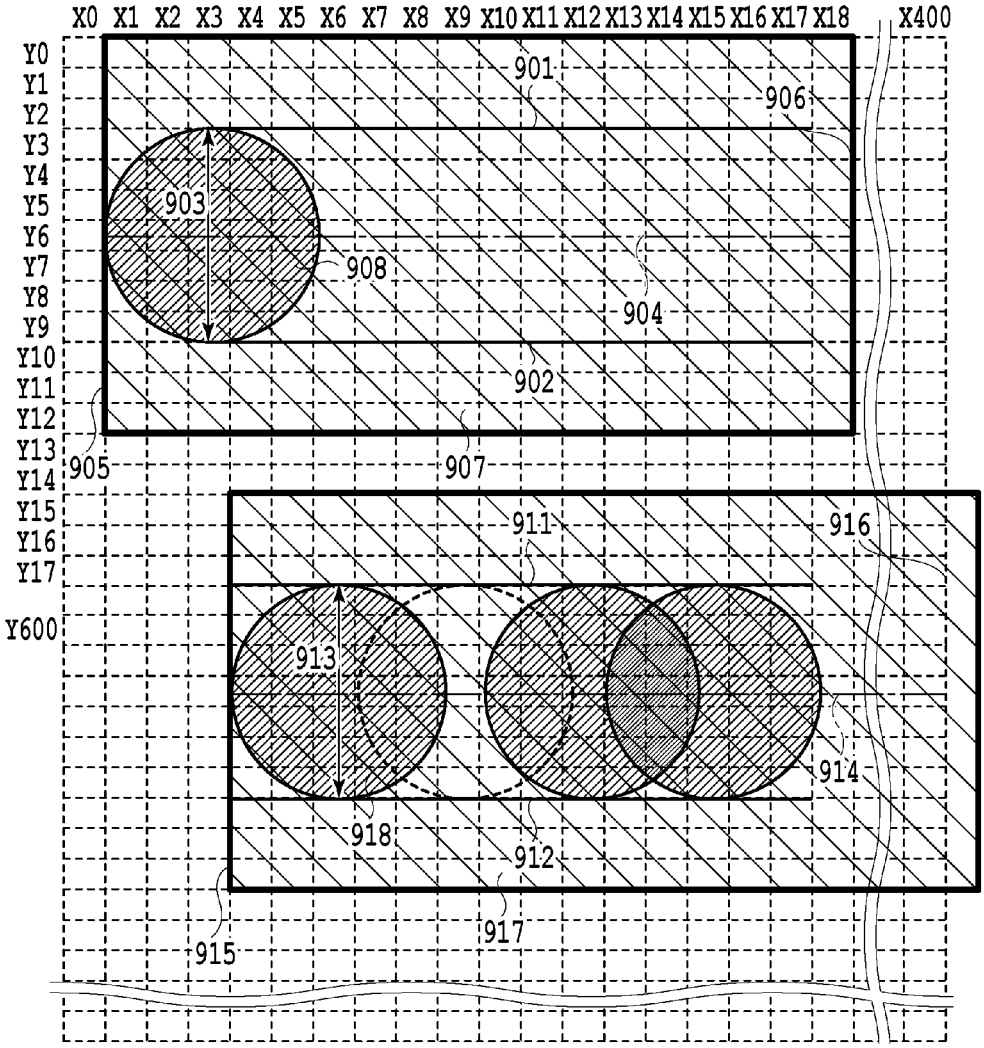
FIG. 9 is a diagram schematically illustrating another method for recognizing a pattern formed of ink droplets ejected from one ejection port.

FIG. 9 is a diagram schematically illustrating another method for recognizing a pattern formed of droplets ejected from one ejection port in the present embodiment. In a case where the pattern illustrated in FIG. 8 is to be measured by the method described in the first embodiment, two limitation areas 907 and 917 are set, as illustrated in FIG. 9. This is because all dots cannot fall within one limitation area due to the large shift of the landing position of the first dot 804.

In order to accurately measure the position even in the state illustrated in FIG. 8, area filtration is carried out in the present embodiment. If the area filtration for removing the first dot 804 was carried out in step S203 in FIG. 6, like the first embodiment, a second dot 802 would be probably removed. In order to avoid such a probability, labeling is first carried out so as to set the limitation areas 907 and 917. With respect to the second dot 802, black pixels (i.e., a dot 805 and a dot 806) within the limitation area 917 are regarded as ink droplets ejected from one ejection port, and then, the sum S of black pixels within the limitation area is calculated. Thereafter, area filtration is carried out again so as to remove the first dot 804. Here, determination is made according to the following inequality:

$$\text{Sum } S \text{ of black pixels} > (D/2)2 \times PI \times a$$

With this determination, a pattern having only the area of one dot such as the first dot 804 is not covered by the inspection.

Here, a constant a depends on a satellite droplet or bleeding on a sheet. The constant a is equal to 1.2 in the present embodiment. When the determination inequality becomes real, the dot is regarded as the measurement dot so that the pattern is recognized.

(Measurement Flow)

Figure 10:
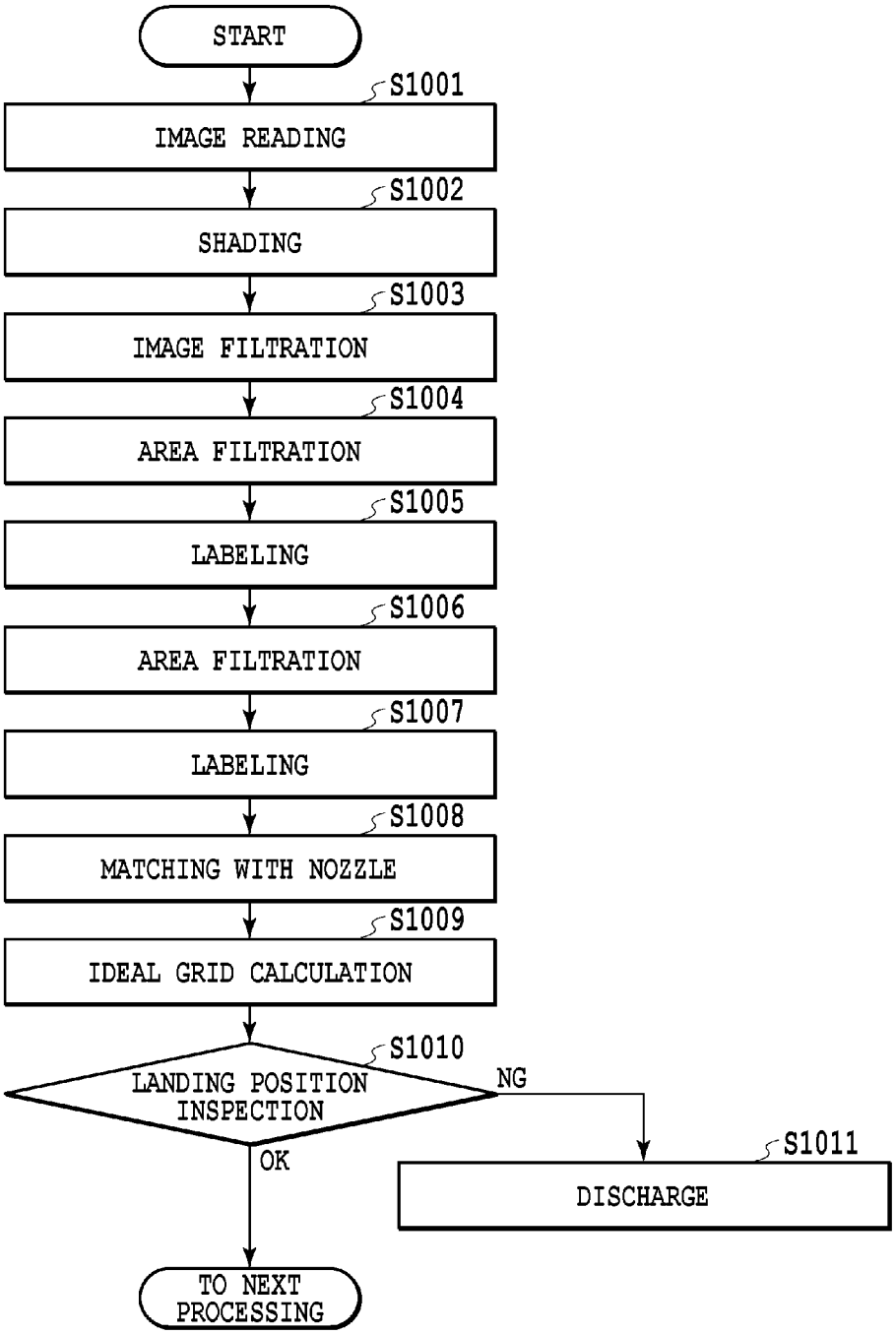
FIG. 10 is a flowchart illustrating another inspection after an ink droplet is landed.

FIG. 10 is a flowchart illustrating inspection in landing position measurement after an ink droplet is landed by the inkjet print head in the present embodiment. A description will be given below of an inspection flow in the present embodiment with reference to the flowchart.

The processing in each of step S1001 to step S1005 is identical to that in the first embodiment, and therefore, explanation is omitted here.

Noise is removed in step S1006 by area filtration under the condition of the above-described determination inequality, as follows:

$$\text{Sum } S \text{ of black pixels} > (D/2)2 \times PI \times a$$

Since noise having the area of one dot or less is removed under this condition, the first dot 804 is removed here. Thereafter, labeling is carried out again in step S1007, thereby eliminating the limitation area 907 whereas setting the limitation area 917 again. And then, the limitation area set in step S1008 is matched with an ejection port for use in forming a pattern within the limitation area.

The processing in each of step S1009 to step S1011 is identical to that in the first embodiment, and therefore, explanation is omitted here.

As described above, when the landing position of an ink droplet ejected from the inkjet printing head is measured, ink is ejected from one ejection port a plurality of times, and then, the black pixels within the limitation area are recognized as ink ejected from one ejection port, followed by the processing.

In the above-described manner, it is possible to achieve the ink droplet landing position measuring method and the ink droplet landing position measuring apparatus with high accuracy and without any erroneous determination even if deficient ejection or landing shift accidentally occurs when the landing positions of the ink droplets ejected from the plurality of ejection ports are measured.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-261744, filed Dec. 18, 2013, which is hereby incorporated by reference wherein in its entirety.

What is claimed is:

1. A landing position measuring method for measuring the landing position of a droplet ejected from an ejection port of a liquid ejection head onto a medium, the landing position measuring method comprising the steps of:

forming a pattern with a plurality of droplets ejected from the one ejection port;

setting a limitation area including the pattern;

obtaining the position of gravity of the limitation area;

calculating the ideal position of the pattern based on the positions of gravity of the plurality of limitation areas; and measuring the landing position of the droplet ejected from the ejection port based on the position of gravity of the limitation area.

2. The landing position measuring method according to claim 1, wherein the limitation area is set based on the landing positions of the plurality of droplets forming the pattern.

3. The landing position measuring method according to claim 2, wherein the landing positions of droplets to be ejected are shifted in a predetermined direction in such a manner that the droplets overlap each other by a predetermined area; and when XY coordinates are applied to a medium, onto which the droplets are ejected, the landing position includes information on a maximum Y coordinate value out of positions, at which the plurality of droplets area landed, in the Y coordinates indicating a direction crossing the predetermined direction and a minimum Y coordinate value out of the positions, at which the plurality of droplets area landed.

4. The landing position measuring method according to claim 1, wherein in a case where the area of the pattern formed with the droplets ejected onto the medium is less than a predetermined value, the pattern is not covered by the measurement.

5. The landing position measuring method according to claim 4, wherein the predetermined area signifies the area of the pattern formed with one droplet ejected onto the medium.

6. A landing position measuring apparatus comprising means configured to carry out the method according to claim 1.

* * * * *